US010655853B2

(12) United States Patent
Burd

(10) Patent No.: US 10,655,853 B2
(45) Date of Patent: May 19, 2020

(54) COMBUSTOR LINER PANEL WITH NON-LINEAR CIRCUMFERENTIAL EDGE FOR A GAS TURBINE ENGINE COMBUSTOR

(71) Applicant: United Technologies Corporation, Farmington, CT (US)

(72) Inventor: Steven W. Burd, Cheshire, CT (US)

(73) Assignee: United Technologies Corporation, Farmington, CT (US)

( * ) Notice: Subject to any disclaimer, the term of this patent is extended or adjusted under 35 U.S.C. 154(b) by 536 days.

(21) Appl. No.: 15/348,639

(22) Filed: Nov. 10, 2016

(65) Prior Publication Data

US 2018/0231250 A1 Aug. 16, 2018

(51) Int. Cl.

| | |
|---|---|
| ***F23M 5/04*** | (2006.01) |
| ***F23R 3/02*** | (2006.01) |
| ***F01D 9/02*** | (2006.01) |
| ***F23M 5/08*** | (2006.01) |
| ***F23R 3/06*** | (2006.01) |
| ***F23R 3/50*** | (2006.01) |
| ***F23R 3/60*** | (2006.01) |

(52) U.S. Cl.

CPC ..... *F23M 5/04* (2013.01); *F01D 9/023* (2013.01); *F23M 5/085* (2013.01); *F23R 3/06* (2013.01); *F23R 3/50* (2013.01); *F23R 3/60* (2013.01); *F23R 2900/03041* (2013.01); *F23R 2900/03042* (2013.01); *F23R 2900/03044* (2013.01)

(58) Field of Classification Search

None

See application file for complete search history.

(56) References Cited

U.S. PATENT DOCUMENTS

| | | | | |
|---|---|---|---|---|
| 4,236,378 A | | 12/1980 | Vogt | |
| 4,302,941 A | | 12/1981 | DuBell | |
| 4,749,029 A | * | 6/1988 | Becker | F23R 3/002 165/169 |
| 4,773,227 A | * | 9/1988 | Chabis | F23R 3/002 60/752 |
| 5,357,744 A | | 10/1994 | Czachor et al. | |

(Continued)

FOREIGN PATENT DOCUMENTS

| | | |
|---|---|---|
| DE | 102015205975 A1 | 10/2016 |
| EP | 1482246 A1 | 12/2004 |

(Continued)

OTHER PUBLICATIONS

European Search Report dated Mar. 9, 2018 for European Patent Application No. 17201184.3.

(Continued)

*Primary Examiner* — William H Rodriguez
*Assistant Examiner* — Rodolphe Andre Chabreyrie
(74) *Attorney, Agent, or Firm* — Bachman & LaPointe, P.C.

(57) ABSTRACT

A combustor for a gas turbine engine including a forward liner panel mounted to a support shell via a multiple of studs, the forward liner panel including an aft non-linear circumferential edge and an aft liner panel mounted to the support shell via a multiple of studs, the aft liner panel including a forward non-linear circumferential edge that is complementary to the aft non-linear circumferential edge.

12 Claims, 8 Drawing Sheets

(56) References Cited

U.S. PATENT DOCUMENTS

| | | | | |
|---|---|---|---|---|
| 5,553,455 | A | 9/1996 | Craig et al. | |
| 6,029,455 | A | 2/2000 | Sandelis | |
| 6,101,814 | A * | 8/2000 | Hoke | F23D 11/007 60/39.37 |
| 6,397,765 | B1 | 6/2002 | Becker | |
| 6,532,929 | B2 | 3/2003 | Antonevich et al. | |
| 6,568,079 | B2 | 5/2003 | Farmer et al. | |
| 6,581,285 | B2 | 6/2003 | Emilianowicz | |
| 6,612,248 | B2 | 9/2003 | Becker | |
| 6,655,146 | B2 | 12/2003 | Kutter et al. | |
| 6,675,582 | B2 | 1/2004 | Monty et al. | |
| 6,868,675 | B1 | 3/2005 | Kuhn et al. | |
| 6,931,855 | B2 | 8/2005 | Glessner et al. | |
| 6,988,369 | B2 | 1/2006 | Conete et al. | |
| 7,246,993 | B2 | 7/2007 | Bolms et al. | |
| 7,363,763 | B2 | 4/2008 | Coughlan, III et al. | |
| 7,524,167 | B2 | 4/2009 | Ohri et al. | |
| 7,726,131 | B2 | 6/2010 | Sze et al. | |
| 7,900,457 | B2 | 3/2011 | Patterson et al. | |
| 8,015,817 | B2 | 9/2011 | Charron et al. | |
| 8,015,829 | B2 | 9/2011 | Coughlan, III et al. | |
| 8,069,670 | B2 | 12/2011 | Schmahl et al. | |
| 8,141,370 | B2 | 3/2012 | Bulman et al. | |
| 8,245,513 | B2 | 8/2012 | Huth et al. | |
| 8,256,223 | B2 | 9/2012 | Dierberger et al. | |
| 8,418,470 | B2 | 4/2013 | Burd | |
| 8,505,306 | B2 | 8/2013 | Dierberger et al. | |
| 8,984,896 | B2 | 3/2015 | Davenport et al. | |
| 9,243,515 | B2 | 1/2016 | McAlice et al. | |
| 9,249,732 | B2 | 2/2016 | McAlice et al. | |
| 9,335,048 | B2 | 5/2016 | Bagchi | |
| 9,404,391 | B2 | 8/2016 | Brühwiler | |
| 9,410,702 | B2 | 8/2016 | Dudebout et al. | |
| 9,423,129 | B2 | 8/2016 | Graves et al. | |
| 9,482,432 | B2 | 11/2016 | Cunha et al. | |
| 9,835,332 | B2 | 12/2017 | Jopp et al. | |
| 2004/0182085 | A1 | 9/2004 | Jeppel et al. | |
| 2007/0144178 | A1 | 6/2007 | Burd et al. | |
| 2008/0010992 | A1 * | 1/2008 | Patterson | F23R 3/06 60/772 |
| 2008/0104963 | A1 | 5/2008 | Grote et al. | |
| 2009/0193813 | A1 | 8/2009 | Garry et al. | |
| 2009/0199837 | A1 | 8/2009 | Tschirren et al. | |
| 2010/0242486 | A1 | 9/2010 | Jarmon et al. | |
| 2010/0251721 | A1 | 10/2010 | Morrison et al. | |
| 2011/0027569 | A1 | 2/2011 | Richards | |
| 2011/0030378 | A1 | 2/2011 | Carlisle | |
| 2011/0113785 | A1 | 5/2011 | Tschuor et al. | |
| 2011/0185737 | A1 | 8/2011 | Dierberger et al. | |
| 2011/0185740 | A1 | 8/2011 | Dierberger et al. | |
| 2011/0305582 | A1 * | 12/2011 | Lee | F01D 5/186 416/97 R |
| 2012/0144835 | A1 | 6/2012 | Taylor et al. | |
| 2012/0198854 | A1 | 8/2012 | Schilp et al. | |
| 2012/0210719 | A1 | 8/2012 | Dierberger et al. | |
| 2012/0234402 | A1 | 9/2012 | Richards | |
| 2012/0275900 | A1 | 11/2012 | Snider et al. | |
| 2013/0019603 | A1 | 1/2013 | Dierberger et al. | |
| 2013/0055722 | A1 | 3/2013 | Verhiel et al. | |
| 2013/0192262 | A1 | 8/2013 | Eastwood et al. | |
| 2014/0020393 | A1 | 1/2014 | Nakamata et al. | |
| 2014/0096527 | A1 | 4/2014 | Bangerter et al. | |
| 2015/0260401 | A1 | 9/2015 | Gerendás et al. | |
| 2015/0260403 | A1 * | 9/2015 | Clemen | F23R 3/002 60/752 |
| 2015/0330633 | A1 | 11/2015 | Graves et al. | |
| 2015/0362191 | A1 | 12/2015 | Papple et al. | |
| 2015/0362192 | A1 | 12/2015 | Cunha et al. | |
| 2016/0054001 | A1 | 2/2016 | Bangerter et al. | |
| 2016/0109129 | A1 * | 4/2016 | Rettig | F23M 5/02 60/753 |
| 2016/0186999 | A1 | 6/2016 | Freeman et al. | |
| 2016/0258624 | A1 * | 9/2016 | Harding | F23R 3/002 |
| 2016/0281988 | A1 | 9/2016 | Tu, Jr. et al. | |
| 2017/0241643 | A1 | 8/2017 | Mulcaire et al. | |
| 2018/0038593 | A1 | 2/2018 | Quach et al. | |

FOREIGN PATENT DOCUMENTS

| | | | |
|---|---|---|---|
| EP | 2846097 | A2 | 3/2015 |
| EP | 2905538 | A1 | 8/2015 |
| EP | 3040617 | A1 | 7/2016 |
| EP | 3054218 | A1 | 8/2016 |
| EP | 3279568 | A1 | 2/2018 |
| GB | 2432902 | A | 6/2007 |
| WO | 03006883 | A1 | 1/2003 |
| WO | 2014169127 | A1 | 10/2014 |
| WO | 2016156370 | A1 | 10/2016 |

OTHER PUBLICATIONS

European Search Report dated Mar. 27, 2018 for European Patent Application No. 17201138.9.

European Search Report dated Mar. 5, 2018 for corresponding European Patent Application 17201213.0.

European Search Report dated Mar. 6, 2018 for European Patent Application 17201191.8.

U.S. Office action dated Nov. 15, 2018 in corresponding U.S. Appl. No. 15/348,679.

European Office Action dated Feb. 28, 2019 issued for European Patent Application 17201184.3.

U.S. Final Office Action dated Apr. 29, 2019 for corresponding U.S. Appl. No. 15/348,679.

U.S. Office Action dated Apr. 2, 2019 for corresponding U.S. Appl. No. 15/348,619.

U.S. Office Action dated Apr. 2, 2019 for corresponding U.S. Appl. No. 15/348,568.

EP Final Office Action dated Jul. 16, 2019 issued in corresponding European Patent Application No. 17201138.9.

* cited by examiner

COMBUSTOR LINER PANEL WITH NON-LINEAR CIRCUMFERENTIAL EDGE FOR A GAS TURBINE ENGINE COMBUSTOR

BACKGROUND

The present disclosure relates to a gas turbine engine and, more particularly, to a combustor section therefor.

Gas turbine engines, such as those that power modern commercial and military aircraft, generally include a compressor section to pressurize an airflow, a combustor section to burn a hydrocarbon fuel in the presence of the pressurized air, and a turbine section to extract energy from the resultant combustion gases.

Among the engine components, relatively high temperatures are observed in the combustor section such that cooling airflow is provided to meet desired service life requirements. The combustor section typically includes a combustion chamber formed by an inner and outer wall assembly. Each wall assembly includes a support shell lined with heat shields often referred to as liner panels. Combustor panels are often employed in modern annular gas turbine combustors to form the inner flow path. The panels are part of a two-wall liner and are exposed to a thermally challenging environment.

In typical combustor chamber designs, combustor Impingement Film-Cooled Floatwall (IFF) liner panels typically include a hot side exposed to the gas path. The opposite, or cold side, has features such as cast in threaded studs to mount the liner panel and a full perimeter rail that contact the inner surface of the liner shells.

The wall assemblies are segmented to accommodate growth of the panels in operation and for other considerations. Combustor panels typically have a quadrilateral projection (i.e. rectangular or trapezoid) when viewed from the hot surface. The panels have a straight edge that forms the front or upstream edge of the panel and a second straight edge that forms the back or downstream edge of the combustor. The panels also have side edges that are linear in profile.

The liner panels extend over an arc in a conical or cylindrical fashion in a plane and terminate in regions where the combustor geometry transitions, diverges, or converges. This may contribute to durability and flow path concerns where forward and aft panels merge or form interfaces. These areas can be prone to steps between panels, dead regions, cooling challenges and adverse local aerodynamics.

SUMMARY

A liner panel for use in a combustor of a gas turbine engine, the liner panel according to one disclosed non-limiting embodiment of the present disclosure can include at least one of a forward section and an aft section that defines a non-linear circumferential edge.

A further embodiment of the present disclosure may include, wherein the liner panel is a forward liner panel that is mountable adjacent to an aft liner panel at a non-linear interface.

A further embodiment of the present disclosure may include, wherein the liner panel is an aft liner panel that is mountable adjacent to a forward liner panel at a non-linear interface.

A further embodiment of the present disclosure may include, wherein the non-linear circumferential edge defines a non-linear interface.

A further embodiment of the present disclosure may include, wherein the non-linear circumferential edge is defined with respect to each of a multiple of studs that extends from a cold side of the liner panel.

A further embodiment of the present disclosure may include, wherein the non-linear circumferential edge is spaced a distance D1 from each of the multiple of studs, the distance D1 is 2.0X-10X where X is a diameter of the stud.

A further embodiment of the present disclosure may include, wherein the non-linear circumferential edge is defined with respect to each of a multiple of dilution passages through the liner panel.

A further embodiment of the present disclosure may include, wherein the non-linear circumferential edge is spaced a distance D2 from each of the multiple of dilution passages, the distance D2 is 0.5X-2X where X is the diameter of the dilution passage.

A further embodiment of the present disclosure may include, wherein the non-linear circumferential edge is defined with respect to each of a multiple of studs that extends from a cold side of the liner panel and with respect to each of a multiple of dilution passages through the liner panel.

A further embodiment of the present disclosure may include, wherein the non-linear circumferential edge is spaced a distance D1 from each of the multiple of studs, the distance D1 is 2.0X-10X where X is a diameter of the stud and wherein the non-linear circumferential edge is spaced a distance D2 from each of the multiple of dilution passages, the distance D2 is 0.5X-2X where X is the diameter of the dilution passage.

A further embodiment of the present disclosure may include, wherein the forward non-linear circumferential edge and the aft non-linear circumferential edge form a non-linear interface that repeats for each liner panel.

A further embodiment of the present disclosure may include, wherein the forward non-linear circumferential edge and the aft non-linear circumferential edge form a non-linear interface forms a non-linear interface that extends over at least two of the adjacent panels.

A combustor for a gas turbine engine according to one disclosed non-limiting embodiment of the present disclosure can include a support shell; a forward liner panel mounted to the support shell via a multiple of studs, the forward liner panel including an aft non-linear circumferential edge; and an aft liner panel mounted to the support shell via a multiple of studs, the aft liner panel including a forward non-linear circumferential edge that is complementary to the aft non-linear circumferential edge.

A further embodiment of the present disclosure may include, wherein the forward non-linear circumferential edge and the aft non-linear circumferential edge form a non-linear interface.

A further embodiment of the present disclosure may include, wherein the forward and aft non-linear circumferential edges are defined with respect to each of a multiple of studs.

A further embodiment of the present disclosure may include, wherein the non-linear circumferential edges are spaced a distance D1 from each of the multiple of studs, the distance D1 is 2.0X-10X where X is a diameter of the stud.

A further embodiment of the present disclosure may include, wherein the forward and aft non-linear circumferential edges are defined with respect to each of a multiple of dilution passages.

A further embodiment of the present disclosure may include, wherein the forward and aft non-linear circumferential edges are spaced a distance D2 from each of the multiple of dilution passages, the distance D2 is 0.5X-2X where X is the diameter of the dilution passage.

A further embodiment of the present disclosure may include, wherein the forward and aft non-linear circumferential edges are defined with respect to each of a multiple of studs and with respect to each of a multiple of dilution passages.

A further embodiment of the present disclosure may include, wherein the forward and aft non-linear circumferential edges are spaced a distance D1 from each of the multiple of studs, the distance D1 is 2.0X-10X where X is a diameter of the stud, and wherein the forward and aft non-linear circumferential edges are spaced a distance D2 from each of the multiple of dilution passages, the distance D2 is 0.5X-2X where X is the diameter of the dilution passage.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
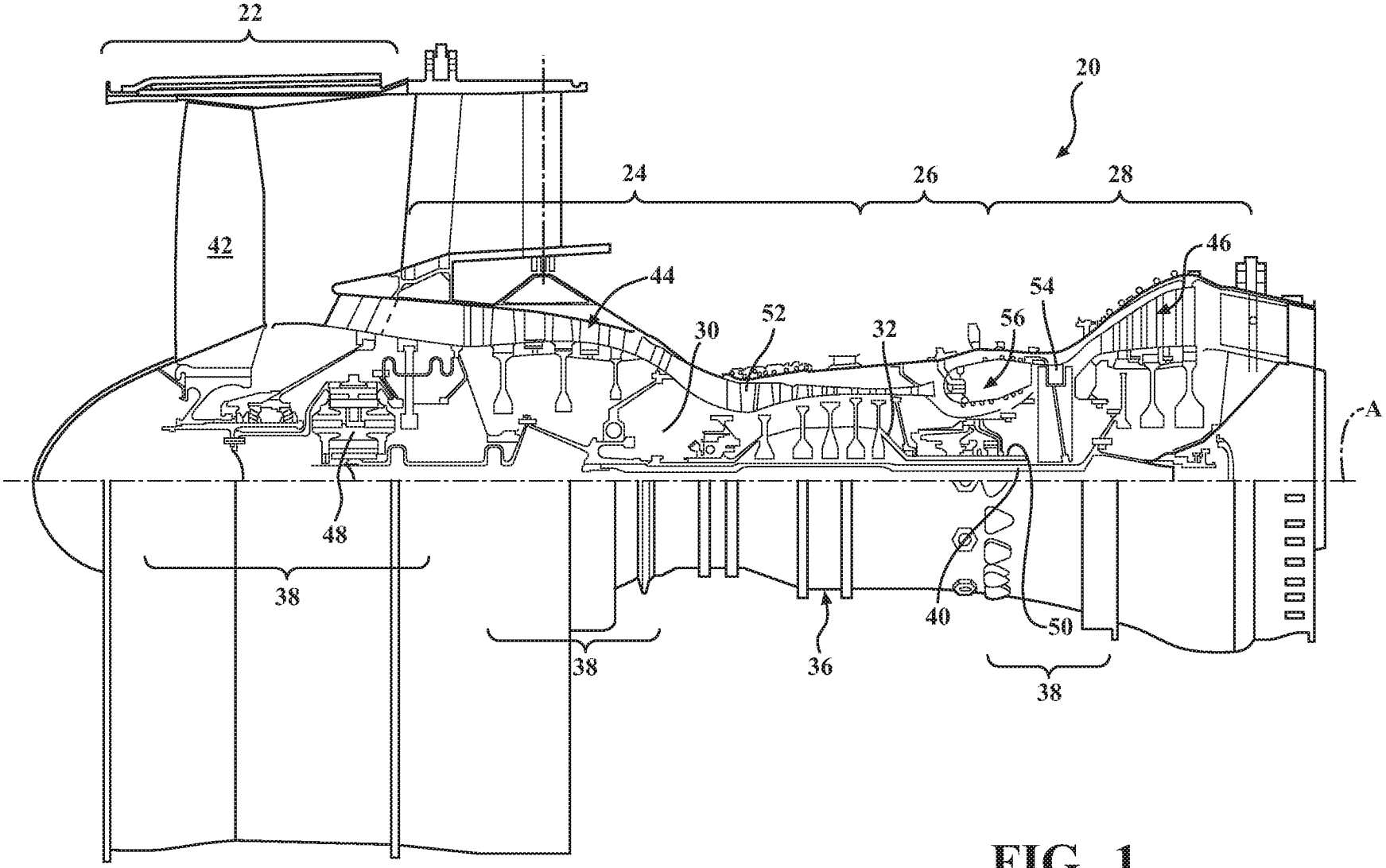
FIG. 1 is a schematic cross-section of an example gas turbine engine architecture.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. Alternative engine architectures might include an augmentor section among other systems or features. The fan section 22 drives air along a bypass flowpath and into the compressor section 24. The compressor section 24 drives air along a core flowpath for compression and communication into the combustor section 26, which then expands and directs the air through the turbine section 28. Although depicted as a turbofan in the disclosed non-limiting embodiment, it should be appreciated that the concepts described herein are not limited to use with turbofans as the teachings may be applied to other types of turbine engines such as a turbojets, turboshafts, and three-spool (plus fan) turbofans wherein an intermediate spool includes an intermediate pressure compressor ("IPC") between a Low Pressure Compressor ("LPC") and a High Pressure Compressor ("HPC"), and an intermediate pressure turbine ("IPT") between the high pressure turbine ("HPT") and the Low pressure Turbine ("LPT").

The engine 20 generally includes a low spool 30 and a high spool 32 mounted for rotation about an engine central longitudinal axis A relative to an engine static structure 36 via several bearing structures 38. The low spool 30 generally includes an inner shaft 40 that interconnects a fan 42, a low pressure compressor ("LPC") 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and high pressure turbine ("HPT") 54. A combustor 56 is arranged between the HPC 52 and the HPT 54. The inner shaft 40 and the outer shaft 50 are concentric and rotate about the engine central longitudinal axis A which is collinear with their longitudinal axes.

Core airflow is compressed by the LPC 44, then the HPC 52, mixed with the fuel and burned in the combustor 56, then expanded over the HPT 54 and the LPT 46. The LPT 46 and HPT 54 rotationally drive the respective low spool 30 and high spool 32 in response to the expansion. The main engine shafts 40, 50 are supported at a plurality of points by bearing systems 38 within the static structure 36.

In one non-limiting example, the gas turbine engine 20 is a high-bypass geared aircraft engine. In a further example, the gas turbine engine 20 bypass ratio is greater than about six (6:1). The geared architecture 48 can include an epicyclic gear train, such as a planetary gear system or other gear system. The example epicyclic gear train has a gear reduction ratio of greater than about 2.3, and in another example is greater than about 2.5:1. The geared turbofan enables operation of the low spool 30 at higher speeds which can increase the operational efficiency of the LPC 44 and LPT 46 and render increased pressure in a fewer number of stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be appreciated, however, that the above parameters are only exemplary of one embodiment of a geared architecture engine and that the present disclosure is applicable to other gas turbine engines including direct drive turbofans.

In one embodiment, a significant amount of thrust is provided by the bypass flow due to the high bypass ratio.

The fan section 22 of the gas turbine engine 20 is designed for a particular flight condition—typically cruise at about 0.8 Mach and about 35,000 feet (10668 m). This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{“Tram”}/518.7)^{0.5}$. The Low Corrected Fan Tip Speed according to one non-limiting embodiment of the example gas turbine engine 20 is less than about 1150 fps (351 m/s).

Figure 2:
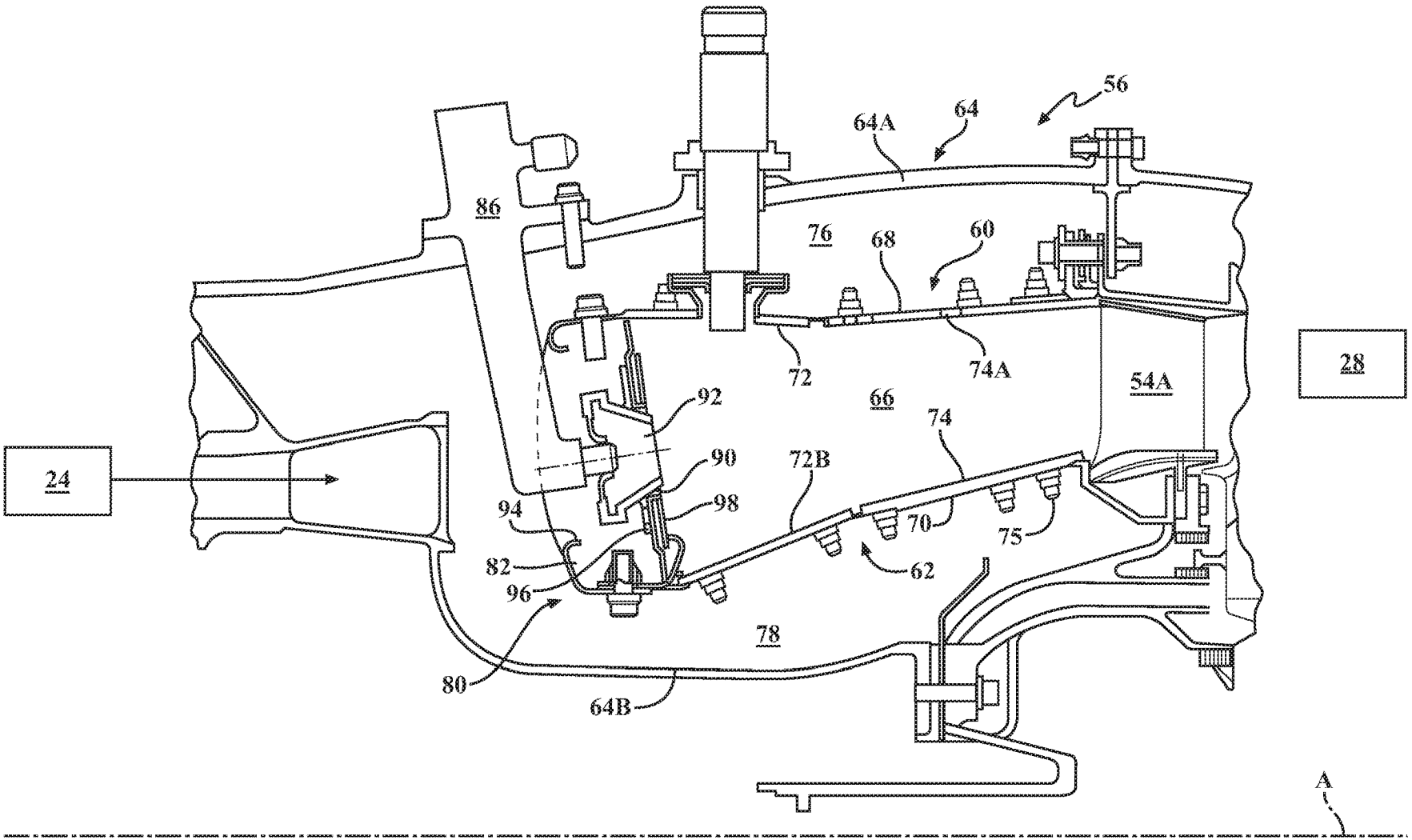
FIG. 2 is an expanded longitudinal schematic sectional view of a combustor section according to one non-limiting embodiment that may be used with the example gas turbine engine architectures.

With reference to FIG. 2, the combustor section 26 generally includes a combustor 56 with an outer combustor wall assembly 60, an inner combustor wall assembly 62, and a diffuser case module 64. The outer combustor wall assembly 60 and the inner combustor wall assembly 62 are spaced apart such that a combustion chamber 66 is defined therebetween. The combustion chamber 66 is generally annular in shape to surround the engine central longitudinal axis A.

The outer combustor liner assembly 60 is spaced radially inward from an outer diffuser case 64A of the diffuser case module 64 to define an outer annular plenum 76. The inner combustor liner assembly 62 is spaced radially outward from an inner diffuser case 64B of the diffuser case module 64 to define an inner annular plenum 78. It should be appreciated that although a particular combustor is illustrated, other combustor types with various combustor liner arrangements will also benefit herefrom. It should be further appreciated that the disclosed cooling flow paths are but an illustrated embodiment and should not be limited only thereto.

The combustor wall assemblies 60, 62 contain the combustion products for direction toward the turbine section 28. Each combustor wall assembly 60, 62 generally includes a respective support shell 68, 70 which supports one or more liner panels 72, 74 mounted thereto arranged to form a liner array. The support shells 68, 70 may be manufactured by, for example, the hydroforming of a sheet metal alloy to provide the generally cylindrical outer shell 68 and inner shell 70. Each of the liner panels 72, 74 may be generally rectilinear with a circumferential arc. The liner panels 72, 74 may be manufactured of, for example, a nickel based super alloy, ceramic or other temperature resistant material. In one disclosed non-limiting embodiment, the liner array includes a multiple of forward liner panels 72A and a multiple of aft liner panels 72B that are circumferentially staggered to line the outer shell 68. A multiple of forward liner panels 74A and a multiple of aft liner panels 74B are circumferentially staggered to line the inner shell 70.

The combustor 56 further includes a forward assembly 80 immediately downstream of the compressor section 24 to receive compressed airflow therefrom. The forward assembly 80 generally includes a cowl 82, a bulkhead assembly 84, and a multiple of swirlers 90 (one shown). Each of the swirlers 90 is circumferentially aligned with one of a multiple of fuel nozzles 86 (one shown) and the respective hood ports 94 to project through the bulkhead assembly 84.

The bulkhead assembly 84 includes a bulkhead support shell 96 secured to the combustor walls 60, 62, and a multiple of circumferentially distributed bulkhead liner panels 98 secured to the bulkhead support shell 96 around the swirler opening. The bulkhead support shell 96 is generally annular and the multiple of circumferentially distributed bulkhead liner panels 98 are segmented, typically one to each fuel nozzle 86 and swirler 90.

The cowl 82 extends radially between, and is secured to, the forwardmost ends of the combustor walls 60, 62. The cowl 82 includes a multiple of circumferentially distributed hood ports 94 that receive one of the respective multiple of fuel nozzles 86 and facilitates the direction of compressed air into the forward end of the combustion chamber 66 through a swirler opening 92. Each fuel nozzle 86 may be secured to the diffuser case module 64 and project through one of the hood ports 94 and through the swirler opening 92 within the respective swirler 90.

The forward assembly 80 introduces core combustion air into the forward section of the combustion chamber 66 while the remainder enters the outer annular plenum 76 and the inner annular plenum 78. The multiple of fuel nozzles 86 and adjacent structure generate a blended fuel-air mixture that supports stable combustion in the combustion chamber 66.

Opposite the forward assembly 80, the outer and inner support shells 68, 70 are mounted to a first row of Nozzle Guide Vanes (NGVs) 54A in the HPT 54. The NGVs 54A are static engine components which direct core airflow combustion gases onto the turbine blades of the first turbine rotor in the turbine section 28 to facilitate the conversion of pressure energy into kinetic energy. The core airflow combustion gases are also accelerated by the NGVs 54A because of their convergent shape and are typically given a “spin” or a “swirl” in the direction of turbine rotor rotation. The turbine rotor blades absorb this energy to drive the turbine rotor at high speed.

Figure 3:
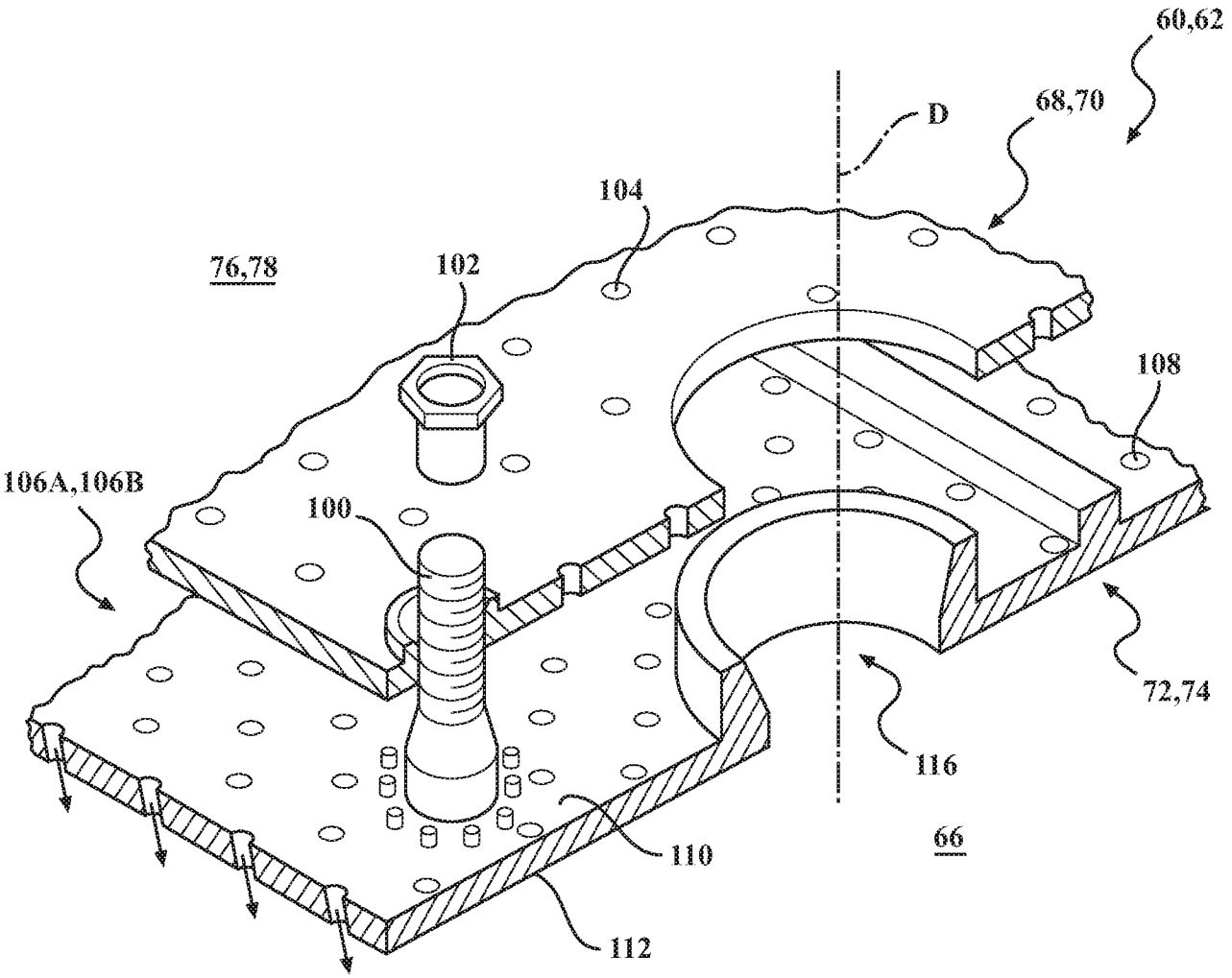
FIG. 3 is an exploded partial sectional view of a portion of a combustor wall assembly.

With reference to FIG. 3, a multiple of studs 100 extend from each of the liner panels 72, 74 so as to permit a liner array (partially shown in FIG. 4) of the liner panels 72, 74 to be mounted to their respective support shells 68, 70 with fasteners 102 such as nuts. That is, the studs 100 project rigidly from the liner panels 72, 74 to extend through the respective support shells 68, 70 and receive the fasteners 102 on a threaded section thereof (FIG. 5).

A multiple of cooling impingement passages 104 penetrate through the support shells 68, 70 to allow air from the respective annular plenums 76, 78 to enter cavities 106 formed in the combustor walls 60, 62 between the respective support shells 68, 70 and liner panels 72, 74. The impingement passages 104 are generally normal to the surface of the liner panels 72, 74. The air in the cavities 106 provides cold side impingement cooling of the liner panels 72, 74 that is generally defined herein as heat removal via internal convection.

A multiple of effusion passages 108 penetrate through each of the liner panels 72, 74. The geometry of the passages, e.g., diameter, shape, density, surface arcuate surface, incidence arcuate surface, etc., as well as the location of the passages with respect to the high temperature combustion flow also contributes to effusion cooling. The effusion passages 108 allow the air to pass from the cavities 106 defined in part by a cold side 110 of the liner panels 72, 74 to a hot side 112 of the liner panels 72, 74 and thereby facilitate the formation of a thin, relatively cool, film of cooling air along the hot side 112.

Figure 6:
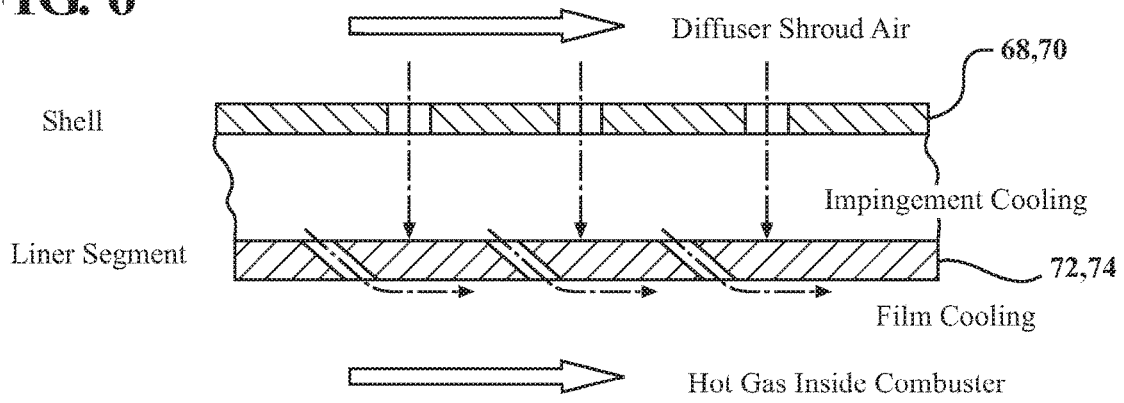
FIG. 6 is a sectional view of a portion of a combustor wall assembly.

In one disclosed non-limiting embodiment, each of the multiple of effusion passages 108 are typically 0.025" (0.635 mm) in diameter and define a surface arcuate surface section of about thirty (30) degrees with respect to the cold side 110 of the liner panels 72, 74. The effusion passages 108 are generally more numerous than the impingement passages 104 and promote film cooling along the hot side 112 to sheath the liner panels 72, 74 (FIG. 6). Film cooling as defined herein is the introduction of a relatively cooler air at one or more discrete locations along a surface exposed to a high temperature environment to protect that surface in the region of the air injection as well as downstream thereof.

The combination of impingement passages 104 and effusion passages 108 may be referred to as an Impingement Film Floatwall (IFF) assembly. A multiple of dilution passages 116 are located in the liner panels 72, 74 each along a common axis D. For example only, the dilution passages 116 are located in a circumferential line W (shown partially in FIG. 4). Although the dilution passages 116 are illustrated in the disclosed non-limiting embodiment as within the aft liner panels 72B, 74B, the dilution passages may alternatively be located in the forward liner panels 72A, 72B or in a single liner panel which replaces the fore/aft liner panel array. Further, the dilution passages 116 although illustrated in the disclosed non-limiting embodiment as integrally formed in the liner panels, it should be appreciated that the dilution passages 116 may be separate components. Whether integrally formed or separate components, the dilution passages 116 may be referred to as grommets.

Figure 4:
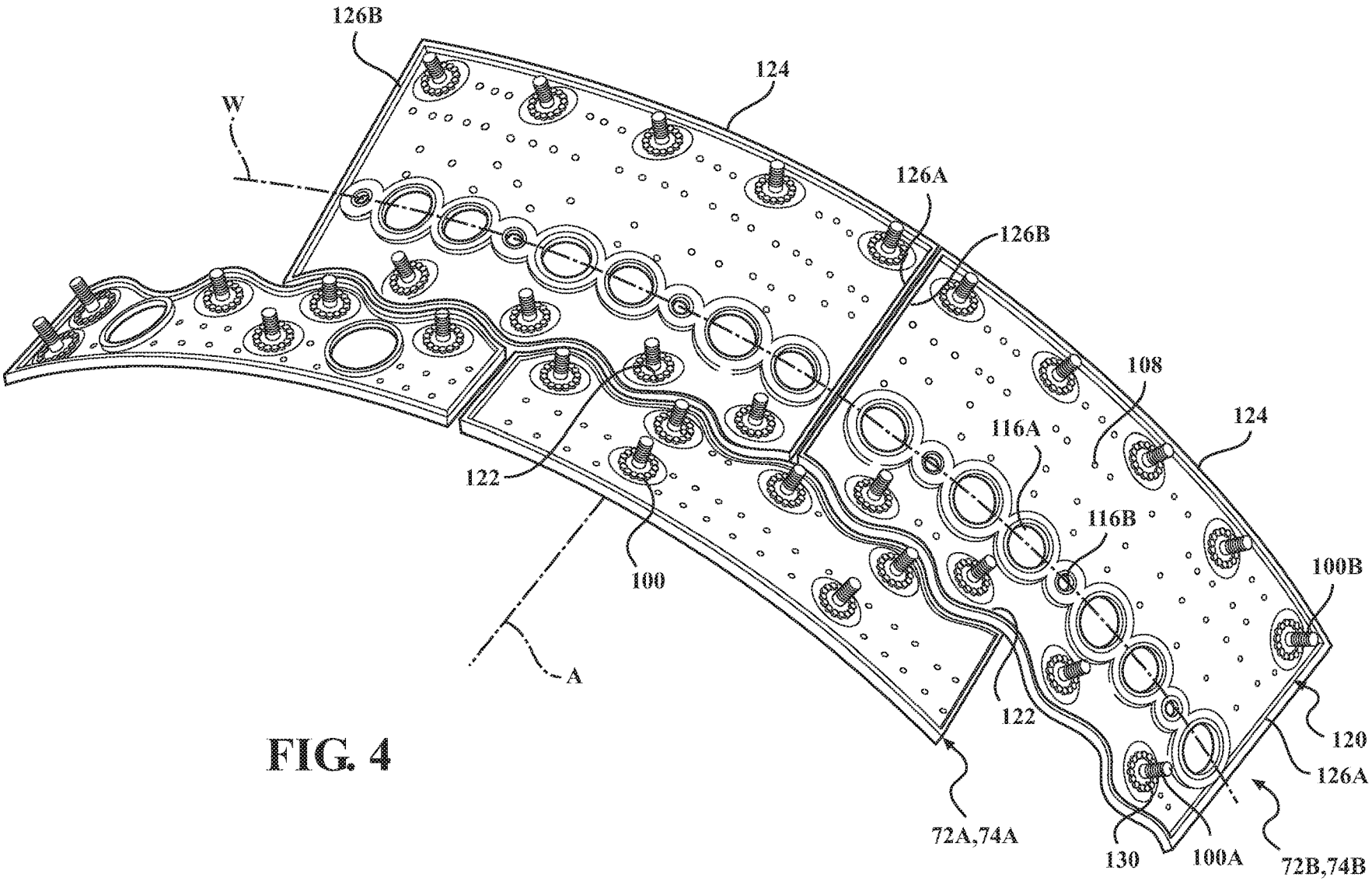
FIG. 4 is a perspective cold side view of a portion of a liner panel array.
Figure 5:
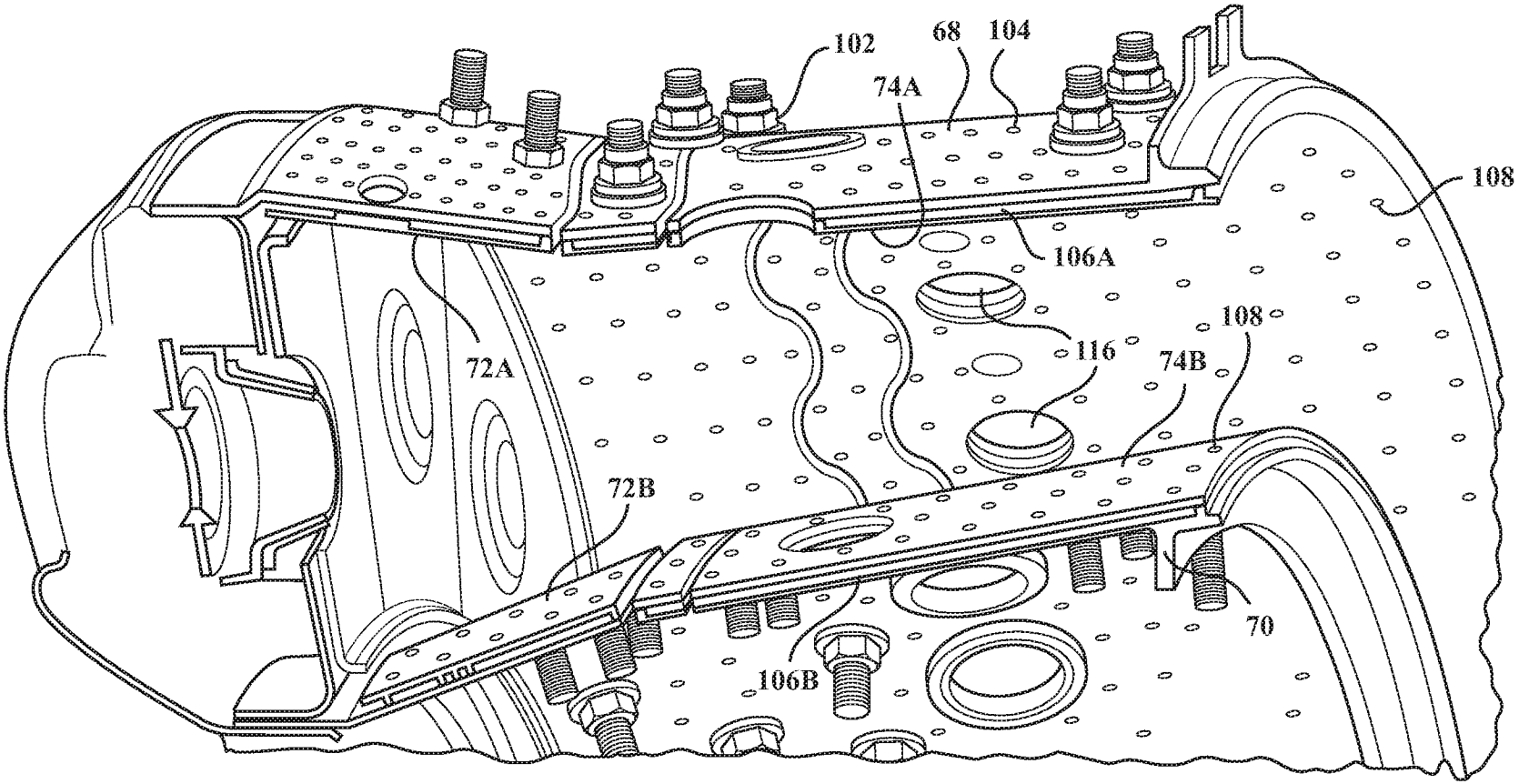
FIG. 5 is a perspective partial sectional view of a combustor.

With reference to FIG. 4, in one disclosed non-limiting embodiment, each of the forward liner panels 72A, 72B, and the aft liner panels 74A, 74B in the liner panel array includes a perimeter rail 120*a*, 120*b* formed adjacent to a forward circumferential edge 122*a*, 122*b*, an aft circumferential edge 124*a*, 124*b*, and axial edges 126Aa 126Ab, 126Ba, 126Bb, that interconnect the forward and aft circumferential edge 122*a*, 122*b*, 124*a*, 124*b*. The perimeter rail 120*a*, 120*b* is located adjacent to the edge of the respective forward liner panels 72A, 72B, and the aft liner panels 74A, 74B to seal each liner panel with respect to the respective support shell 68, 70 to form the impingement cavity 106 therebetween. That is, the forward and aft circumferential edge 122*a*, 122*b*, 124*a*, 124*b* are located at relatively constant curvature shell interfaces while the axial edges 126Aa 126Ab, 126Ba, 126Bb, extend across an axial length of the respective support shell 68, 70. The perimeter rail 120*a*, 120*b* may be located adjacent to or form a portion of the forward circumferential edge 122*a*, 122*b*, the aft circumferential edge 124*a*, 124*b*, and the axial edges 126Aa 126Ab, 126Ba, 126Bb to seal the forward liner panels 72A, 72B, and the aft liner panels 74A, 74B to the respective support shell 68, 70.

A multiple of studs 100 are located adjacent to the respective forward and aft circumferential edge 122*a*, 122*b*, 124*a*, 124*b*. Each of the studs 100 may be at least partially surrounded by posts 130 to at least partially support the fastener 102 and provide a stand-off between each forward liner panels 72A, 72B, and the aft liner panels 74A, 74B and respective support shell 68, 70.

The dilution passages 116 are located downstream of the forward circumferential edge 122*a*, 122*b* in the aft liner panels 72B, 74B to quench the hot combustion gases within the combustion chamber 66 by direct supply of cooling air from the respective annular plenums 76, 78. That is, the dilution passages 116 pass air at the pressure outside the combustion chamber 66 directly into the combustion chamber 66.

This dilution air is not primarily used for cooling of the metal surfaces of the combustor shells or panels, but to condition the combustion products within the combustion chamber 66. In this disclosed non-limiting embodiment, the dilution passages 116 include at least one set of circumferentially alternating major dilution passages 116A and minor dilution passages 116B (also shown in FIG. 6). That is, in some circumferentially offset locations, two major dilution passages 116A are separated by one minor dilution passages 116B. Here, every two major dilution passages 116A are separated by one minor dilution passages 116B but may still be considered "circumferentially alternating" as described herein. In one example, each of the major dilution passages 116A is about 0.5" (12.7 mm) in diameter and the total number of major dilution passages 116A communicates about eighty-five percent (85%) of the dilution airflow. The minor dilution passages 116B are each about 0.2" (5.1 mm) in diameter and the total number of minor dilution passages 116B communicates about fifteen percent (15%) of the dilution airflow. It should be appreciated that the dilution passages 116A, 116B need not be circular.

Figure 7:
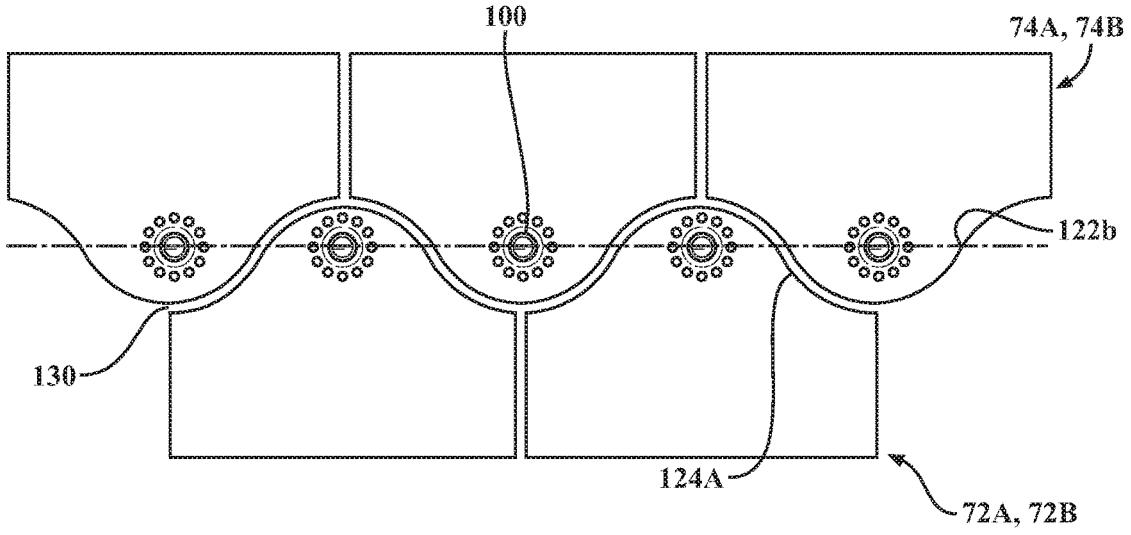
FIG. 7 is a cold side view of a portion of a liner panel array according to one disclosed non-limiting embodiment.

With reference to FIG. 7, the forward liner panels 72A, 72B, include the non-linear aft circumferential edge 124*a* while the aft liner panels 74A, 74B includes the complementary non-linear forward circumferential edge 122*b*. "Complementary," as defined herein, is that the non-linear aft circumferential edge 124*a* fits together with the non-linear forward circumferential edge 122*b* to form a non-linear interface 130. The non-linear interface 130 may be repeated over one or a multiple of adjacent forward and aft liner panels. Further, although illustrated between a forward and aft liner panel, the non-linear interface may be located between other arrays such as between liner and bulkhead panels.

Figure 8:
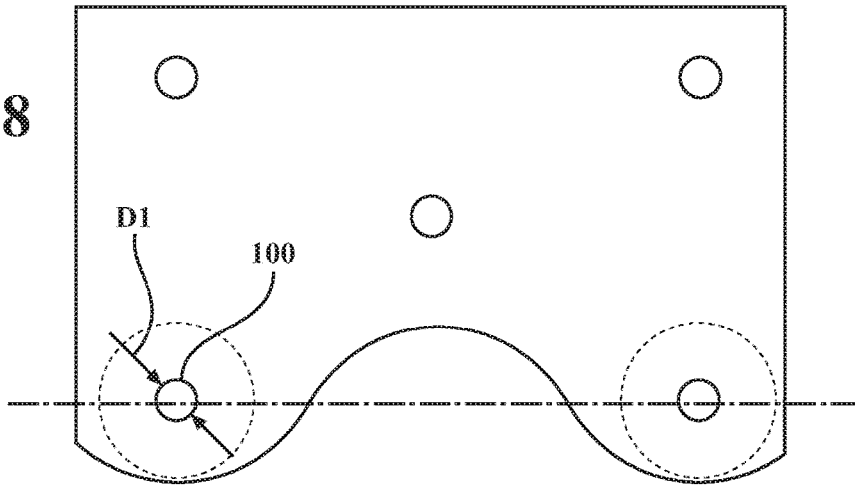
FIG. 8 is an expanded cold side view of a portion of the liner panel array of FIG. 7.

In one non-limiting embodiment, the non-linear aft circumferential edge 124*a* and the non-linear forward circumferential edge 122*b* are contoured with respect to each of the multiple of studs 100. That is, the non-linear aft circumferential edge 124*a* and the non-linear forward circumferential edge 122*b* are spaced a distance D1 from each of the multiple of studs 100. In one example, the distance D1 is 2.0X-10X where X is the diameter of the stud 100 (FIG. 8). In this example, a stud of about 0.25 inches (6.35 mm) results in the respective non-linear aft circumferential edge 124*a* and the non-linear forward circumferential edge 122*b* to be spaced about 0.5-2.5 inches (12.5-63.5 mm) from the stud 100.

Figure 9:
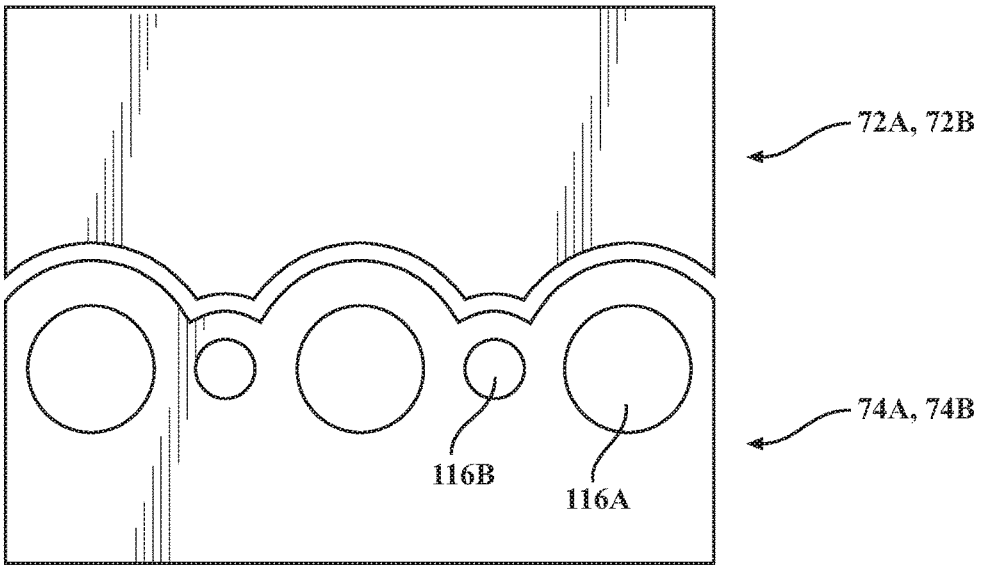
FIG. 9 is a cold side view of a portion of a liner panel array according to another disclosed non-limiting embodiment.
Figure 10:
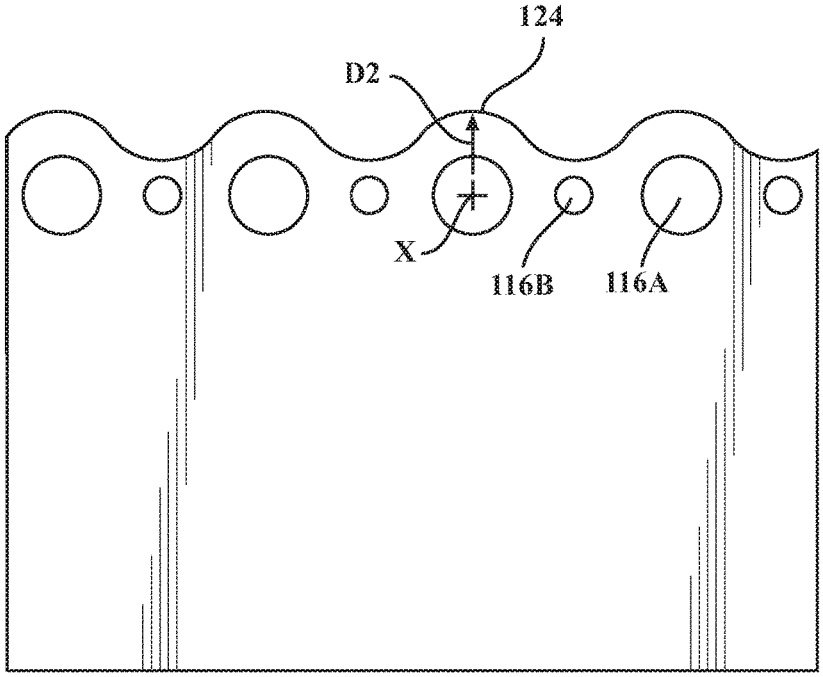
FIG. 10 is an expanded cold side view of a portion of the liner panel array of FIG. 9.

With reference to FIG. 9, in one non-limiting embodiment, the non-linear aft circumferential edge 124*a* and the non-linear forward circumferential edge 122*b* are contoured with respect to each of the multiple of dilution passages 116. That is, the non-linear aft circumferential edge 124*a* and the non-linear forward circumferential edge 122*b* are spaced a distance D2 from each of the multiple of dilution passages 116. In one example, the distance D2 is 0.5X-2X where X is the diameter of the dilution passage 116 (FIG. 10). In this example, a dilution passages 116 of about 0.5 inches (12.7 mm) results in the respective non-linear aft circumferential edge 124*a* and the non-linear forward circumferential edge 122*b* to be spaced about 0.25-1 inches (6.25-25 mm) from the dilution passage 116.

Figure 11:
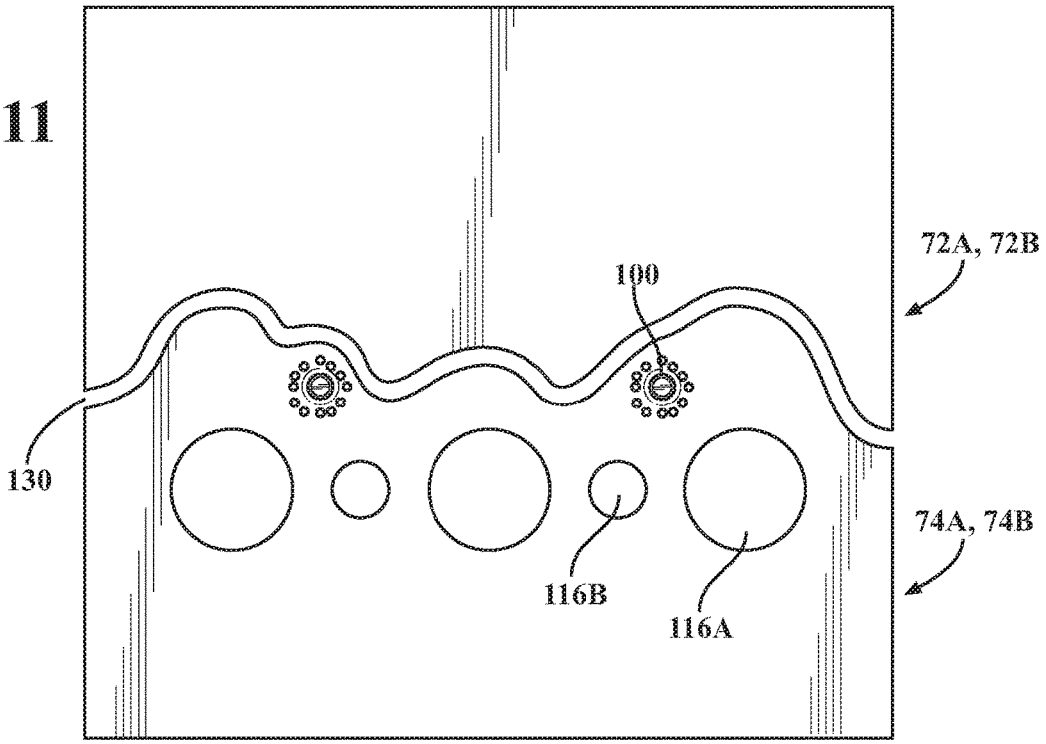
FIG. 11 is a cold side view of a portion of a liner panel array according to another disclosed non-limiting embodiment.

With reference to FIG. 11, in one non-limiting embodiment, the non-linear aft circumferential edge 124*a* and the non-linear forward circumferential edge 122*b* are contoured with respect to each of the multiple of dilution passages 116 as well as each of multiple of studs 100 which may result in a relatively complex forward and aft liner panel interface. The curved edged profiles can be cooled more effectively by providing space between panel features and in areas subject to high heat transfer. The curved edges are also readily employed in cast and machined panel designs and incorporated in dual wall liners and facilitates packaging and repair options for refurbishment of combustors.

The non-linear forward and aft liner panel interface increases combustor durability and the ability to optimize the combustor design and performance. Combustor liners with a kink or bend can eliminate interfaces that result in steps, dead regions, cooling challenges and adverse local aerodynamics. Panels of this geometry edges are readily employed in cast and machined panel designs and incorporated in dual wall liners.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A liner panel array for use in a combustor of a gas turbine engine, the liner panel array comprising:

a first liner panel with a first axial edge and an aft section that defines a first linear panel non-linear circumferential edge; and a second liner panel with a second axial edge and a second liner panel non-linear circumferential edge mounted adjacent to the first panel to match the first liner panel non-linear circumferential edge and define a non-linear interface continuously and successively formed by curves, wherein the non-linear interface is defined with respect to each of a multiple of studs that extends from a cold side of the first liner panel and the second liner panel, wherein the curves of the non-linear interface are escribed at a radial distance D1 from a center of each of the multiple of studs, wherein the first axial edge intersects with one stud of the multiple of studs extending from the second panel and the second axial edge intersect with one stud of the multiple of studs extending form the first panel.

2. The liner panel array as recited in claim 1, wherein the first liner panel is a forward liner panel and the second liner panel is an aft liner panel.

3. The liner panel array as recited in claim 1, wherein the radial distance D1 is between 2 and 10 a diameter of the stud.

4. The liner panel array as recited in claim 1, wherein the non-linear interface is defined with respect to each of a multiple of dilution passages through the liner panel.

5. The liner panel array as recited in claim 4, wherein the curves of the non-linear interface are escribed at a radial distance D2 from a center of each of the multiple of dilution passages, the radial distance D2 is between 0.5 and 2 times the diameter of the dilution passage.

6. The liner panel array as recited in claim 1, wherein the non-linear interface is defined with respect to each of the multiple of studs that extends from a cold side of the first liner panel and the second liner panel and with respect to each of a multiple of dilution passages through the first liner panel and the second liner panel.

7. The liner panel as recited in claim 6, wherein the curves of non-linear interface are escribed at a radial distance D1 from a center each of the multiple of studs, the radial distance D1 is between 2 and 10 times a diameter of the stud and wherein the curves of the non-linear interface are escribed at a radial distance D2 from a center of each of the multiple of dilution passages, the radial distance D2 is between 0.5 and 2 times the diameter of the dilution passage.

8. The liner array panel as recited in claim 1, wherein the non-linear interface repeats for each liner panel.

9. The liner panel array as recited in claim 1, wherein the non-linear interface extends over at least two of the adjacent panels.

10. A combustor for a gas turbine engine comprising:

a support shell;

a forward liner panel mounted to the support shell via a forward multiple of studs, the forward liner panel including an aft non-linear circumferential edge continuously and successively formed by curves; and an aft liner panel mounted to the support shell via an aft multiple of studs, the aft liner panel including a forward non-linear circumferential edge that is continuously and successively formed by curves being complementary to the curves of the aft non-linear circumferential edge, wherein the curves of the forward and aft non-linear circumferential edges are escribed at a radial distance D1 from a center of each of the aft multiple of studs, the radial distance Dl is between 2 and 10 times a diameter of the stud, and wherein the curves of the forward and aft non-linear circumferential edges are escribed at a radial distance D2 from a center of each of a multiple of dilution passages, the radial distance D2 is between 0.5 and 2 times the diameter of the dilution passage.

11. The combustor as recited in claim 10, wherein the forward non-linear circumferential edge and the aft non-linear circumferential edge form a non-linear interface.

12. A combustor for a gas turbine engine comprising:

a support, shell:

a multiple forward liner panels, each forward liner panel mounted to the shell via a respective forward stud of a multiple of forward studs such that each of the multiple of forward liner panels are adjacent one another via a forward axial edge, each forward liner panel comprising an aft non-linear circumferential edge continuously and successively formed by formed curves escribed at a radial distance DI from a center of the respective forward liner pane stud, the radial distance D1 is between 2 and 10 times a diameter of the stud:

a multiple of aft liner panels adjacent to the multiple of forward liner panels along a non-linear circumferential interface, each aft liner panel mounted to the shell via a respective aft stud of a multiple aft studs such that each of the multiple aft liner panels are adjacent one another via an aft axial edge, each aft liner panel comprising a forward non-linear circumferential edge continuously and successively formed by aft curves inscribed at a radial distance D1 from a center of the respective aft liner panel stud, the radial distance Dl is between 2 and 10 times a diameter of the stud, wherein the forward axial edge intersect with one stud of the multiple of aft studs and the aft axial edge intersect with one stud of the multiple of forward studs.

* * * * *